US005203299A

United States Patent [19]

Ueda

[11] Patent Number: 5,203,299

[45] Date of Patent: Apr. 20, 1993

[54] AIR INTAKE SYSTEM FOR A FUEL INJECTION TYPE FOUR CYCLE ENGINE

[75] Inventor: Hideaki Ueda, Iwata, Japan

[73] Assignee: Yamaha Hatsudoki Kabushiki Kaisha, Iwata, Japan

[21] Appl. No.: 834,474

[22] Filed: Feb. 12, 1992

[30] Foreign Application Priority Data

Feb. 22, 1991 [JP] Japan ..... 3-050409

[51] Int. Cl.[5] ..... F02B 31/00

[52] U.S. Cl. ..... 123/308; 123/432; 123/302

[58] Field of Search ..... 123/308, 432, 302

[56] References Cited

U.S. PATENT DOCUMENTS 4,766,853 8/1988 Iwanami ..... 123/308
4,766,866 8/1988 Takii et al. ..... 123/432
4,877,004 10/1989 Nishizawa ..... 123/308

FOREIGN PATENT DOCUMENTS 61-166730 7/1986 Japan .
62-93122 6/1987 Japan .

*Primary Examiner*—David A. Okonsky
*Assistant Examiner*—Erick Solis
*Attorney, Agent, or Firm*—Ernest A. Beutler

[57] ABSTRACT

A motorcycle powered by a fuel injected four cycle internal combustion engine having three valves per cylinder served by a Siamese type intake port arrangement. The centers of the inlet openings of the intake ports are offset from the center of the center intake port served thereby and a single fuel injector is disposed for spraying fuel into each of the intake openings so that all ports will receive equal amounts of fuel and so that the fuel injectors are disposed in parallel relationship to permit a single fuel rail to supply fuel to all of the fuel injectors.

20 Claims, 7 Drawing Sheets

AIR INTAKE SYSTEM FOR A FUEL INJECTION TYPE FOUR CYCLE ENGINE

BACKGROUND OF THE INVENTION

This invention relates to an internal combustion engine and more particularly to an improved induction and fuel injection system for such engines.

It has been acknowledged that the performance of an internal combustion engine can be significantly improved by employing multiple intake valves. Four valve per cylinder engines are quite common and the advantages of a five valve engine over a four valve engine are now being recognized. Five valve engines employ three intake valves and two exhaust valves per cylinder.

Although the use of three intake valves can significantly increase the performance of an engine, it also can in many ways complicate the construction of the engine. In order to provide a less complicated engine, it has been proposed to employ a Siamese type intake port arrangement for such engines. With such an arrangement, a single intake opening is formed in the side of the cylinder head and this intake opening serves three intake valves through a bifurcated intake passage. In order to permit a more compact engine construction, however, it has been proposed to shift the center of the intake opening relative to the intake ports which it serves. By so staggering the offset of the intake openings, the length of the engine can be decreased.

It is also a practice to employ a single charge former for the multiple intake valves and this adds to the simplicity of the engine. When fuel injection is employed, a single manifold injector will spray fuel into the intake opening for serving each of the intake valves for a given combustion chamber. However, when the intake opening is offset from the center of the valves, then the fuel injector is normally offset in the same direction and will not provide equal fuel distribution to the individual valve seats.

Although it is possible to have the fuel injector disposed at an angle so that its spray will be more centrally of the intake passages and supply all of the valve ports equally, there are disadvantages to employing such angled fuel injectors. One of the main of these disadvantages is that it is difficult to provide a common fuel rail for serving multiple fuel injectors when they are offset.

It is, therefore, a principal object of this invention to provide an improved induction system and fuel injection system for a multiple valve internal combustion engine.

It is a further object of this invention to provide an improved Siamese intake system for serving multiple intake valves of a single cylinder of the engine, permitting offsetting of the opening of the intake passages relative to the intake ports and yet employ a single fuel injector that will supply fuel equally to all of the intake ports.

It is a further object of this invention to provide an improved arrangement for the fuel injectors of an internal combustion engine which permits the fuel injectors to extend parallel to each other so that a common fuel rail may be obtained even though the intake passages may be asymmetric.

SUMMARY OF THE INVENTION

A first feature of this invention is adapted to be embodied in an internal combustion engine having a combustion chamber and at least three intake ports serving the combustion chamber in generally side by side fashion. The intake ports comprise a center intake port and a pair of side intake ports which are served from a common intake opening formed in an external surface of the engine by means of a Siamese type intake passage that extends from the intake opening to each of the intake ports for delivering a charge to the intake ports. The common intake opening is offset from the center of the center intake port toward one of the side intake ports. A fuel injector is provided for spraying fuel into the intake passage at a point offset from the center of the intake opening toward the center of the center intake port.

Another feature of the invention is adapted to be embodied in an internal combustion engine having a cylinder bank with a plurality of aligned cylinders, each served by at least three intake ports comprised of a center intake port and a pair of side intake ports. The engine has a plurality of intake openings formed along one side of the engine in aligned fashion with there being one intake opening for each of the cylinders. A plurality of Siamese intake passages each extend from a respective one of the intake openings to the intake ports of the respective cylinder. The centers of the intake openings are offset from the center of the center intake port served by the respective intake opening. A plurality of fuel injectors, one for each cylinder, are provided and are disposed relative to its respective intake opening for spraying fuel in a direction generally along an axis aligned with the center of the respective center intake port served by the respective inlet opening. The fuel injectors all extend substantially parallel to each other and a common fuel rail delivers fuel to each of the fuel injectors.

DETAILED DESCRIPTION OF THE PREFERRED EMBODIMENT OF THE INVENTION

Figure 1:
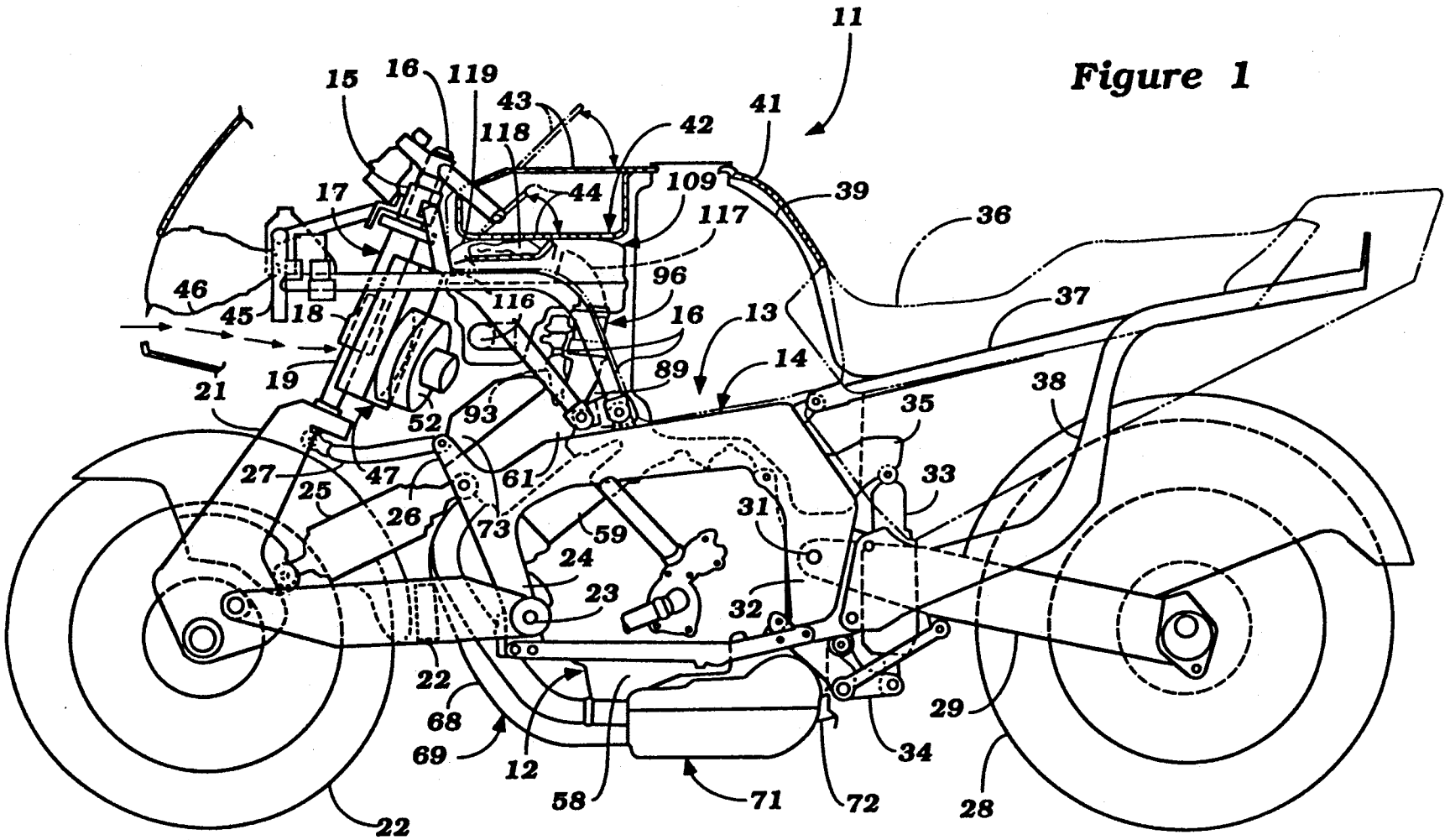
FIG. 1 is a side elevational view of a motorcycle constructed in accordance with an embodiment of the invention, with a portion broken away.
Figure 2:
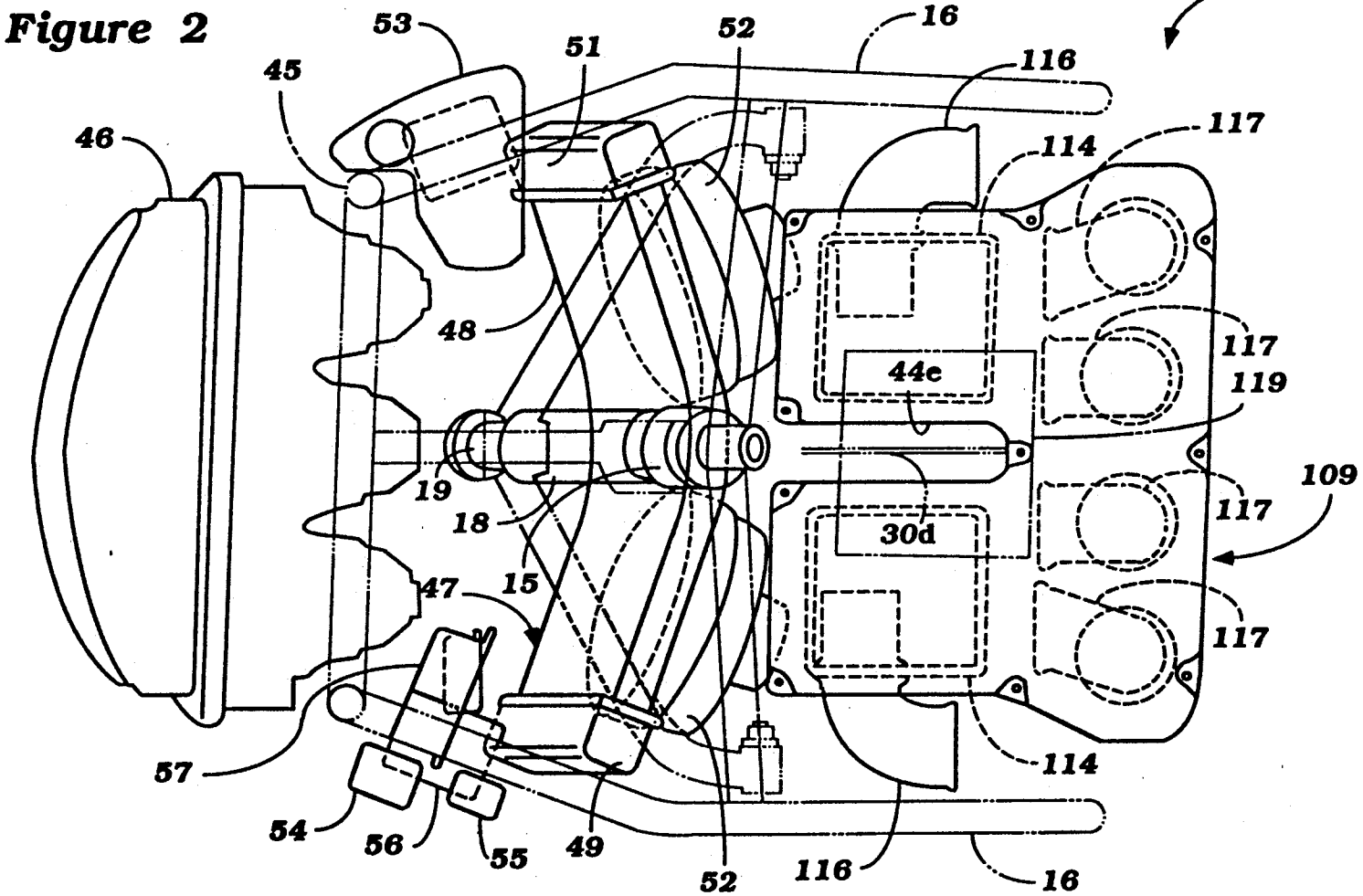
FIG. 2 is an enlarged top plan view of the motorcycle with portions of the body removed to more clearly show the orientation of the engine relative to the frame.

Referring now in detail to the drawings and initially to FIGS. 1 and 2, a motorcycle is depicted and is identified generally by the reference numeral 11. The motorcycle 11 is powered by an internal combustion engine which is constructed in accordance with an embodiment of the invention and which is identified generally by the reference numeral 12. Although the engine 12 is depicted as powering the motorcycle 11, it will be readily apparent to those skilled in the art that the engine may be employed in conjunction with other applications. The invention, however, has particular utility in conjunction with motorcycles because the invention provides a very compact yet highly efficient induction system and compactness is particularly important with motorcycles for obvious reasons.

The motorcycle 11 includes a frame assembly, indicated generally by the reference numeral 13, which includes a pair of side frame members 14 that have a generally inverted U shape. A head pipe 15 is supported from the frame members 14 by means of head brackets 16. The head pipe 15 journals a handlebar assembly 16 that is connected to a steering shaft, indicated generally by the reference numeral 17, which is also supported for rotation by the head pipe 15 and which is comprised of upper and lower portions 18 and 19 which have a splined connection so as to permit axial movement between these members. The lower steering shaft member 19 is connected to a front wheel bracket 21 which, in turn, journals a front wheel 22 for rotation and steering movement. The front wheel bracket 21 is carried at the forward end of a leading front arm 22 that is journaled at its rear end by means of a pivot 23 formed at a lower end 24 of the frame members 14. The front arm 22 has an H-shaped configuration in top plan view.

A suspension element 25 is loaded between the arm 22 and an upper portion 26 of the frame members 14 for cushioning the suspension movement of the front wheel 22 relative to the frame assembly 13. An upper link 27 further controls the suspension movement of the front wheel 22. The front wheel suspension may be of any known type and, since the invention deals primarily with the construction of the engine 12 and its induction system, a further description of the front wheel suspension and steering mechanism is not believed to be necessary to understand the operation of the invention.

A rear wheel 28 is supported by a trailing arm assembly 29 that has a front pivotal connection 31 to the rear depending portions 32 of the frame members 14. A suspension element 33 cushions the suspension movement of the rear wheel 28 and is loaded by means of a linkage system 34 connected between the frame members 14 and the trailing arm 29. The opposite portion of the suspension element 33 is affixed to a bracket 35 carried by the frame members 14.

A seat, shown in phantom and identified by the reference numeral 36, is disposed at least in part over the rear wheel 28 and is carried by means of a pair of seat rails 37 and seat pillars 38 which are affixed to the respective rear portions of the frame side members 14.

A fuel tank 39 is disposed forwardly of the seat 38 and supplies fuel to the engine 12 in a manner which will be described. The fuel tank 39 is at least partially enclosed by a tank cover 41 which may form a portion of the body of the motorcycle. Forwardly of the tank cover 41 there is provided a glove box 42 that is accessible through a pivotally supported access lid 43. The glove box 42 is disposed rearwardly of the head pipe 15. A further access door 44 is provided in the lower surface of the glove box 42 for accessing a control box (to be described) for electronically controlling certain components of the engine such as its fuel injection system and its ignition system.

The head pipe brackets 16 further carry a headlight bracket 45 that extends transversely across the front of the frame assembly 13 and which mounts a headlight 46 in a forward position.

As will be described, the engine 12 is water cooled and there is provided a generally curved radiator assembly, indicated generally by the reference numeral 47, which is disposed so that its bight lies to the rear of the head pipe 15 and its sides extend around the steering shaft 17 and forwardly thereof. The radiator 47 has a core 48 and a pair of header tanks 49 and 51 so as to provide a cross flow action. Water is circulated through the radiator 47 from the cooling jacket of the engine 12 in a manner which will be described. A pair of electric blowers 52 are mounted by the frame assembly 13 to the rear of the core 48 for cooling purposes. Air is drawn across the radiator 47 through an inlet opening formed in a front body portion as shown by the arrows in FIG. 1.

Various auxiliaries are supported around the radiator 47 by the headlight bracket 45 and these include a water recovery tank 53, electrical relays 54 and 55, an ignition coil 56 and a fuse box 57.

Now to the construction of the engine 12, as is typical with motorcycle practice, the engine 12 includes a crankcase transmission assembly 58 that contains the crank shaft of the engine 12 and a change speed transmission which drives the rear wheel 28 in an appropriate manner through either a shaft or chain drive (not shown). A cylinder block 59 extends upwardly and is inclined in a forward direction from the crankcase transmission assembly 58 and has, in the illustrated embodiment, four aligned cylinder bores that are transversely disposed across the motorcycle 11 so that the output shaft or crank shaft of the engine 12 also extends transversely, as is typical in motorcycle practice. Although the invention is described in conjunction with an in-line four cylinder engine, it should be readily apparent to those skilled in the art how the invention can be practiced in conjunction with engines having other cylinder numbers and other cylinder configurations. Also, although the invention has particular utility in conjunction with multiple cylinder engines, certain facets of the invention may be employed in conjunction with single cylinder engines.

Figure 3:
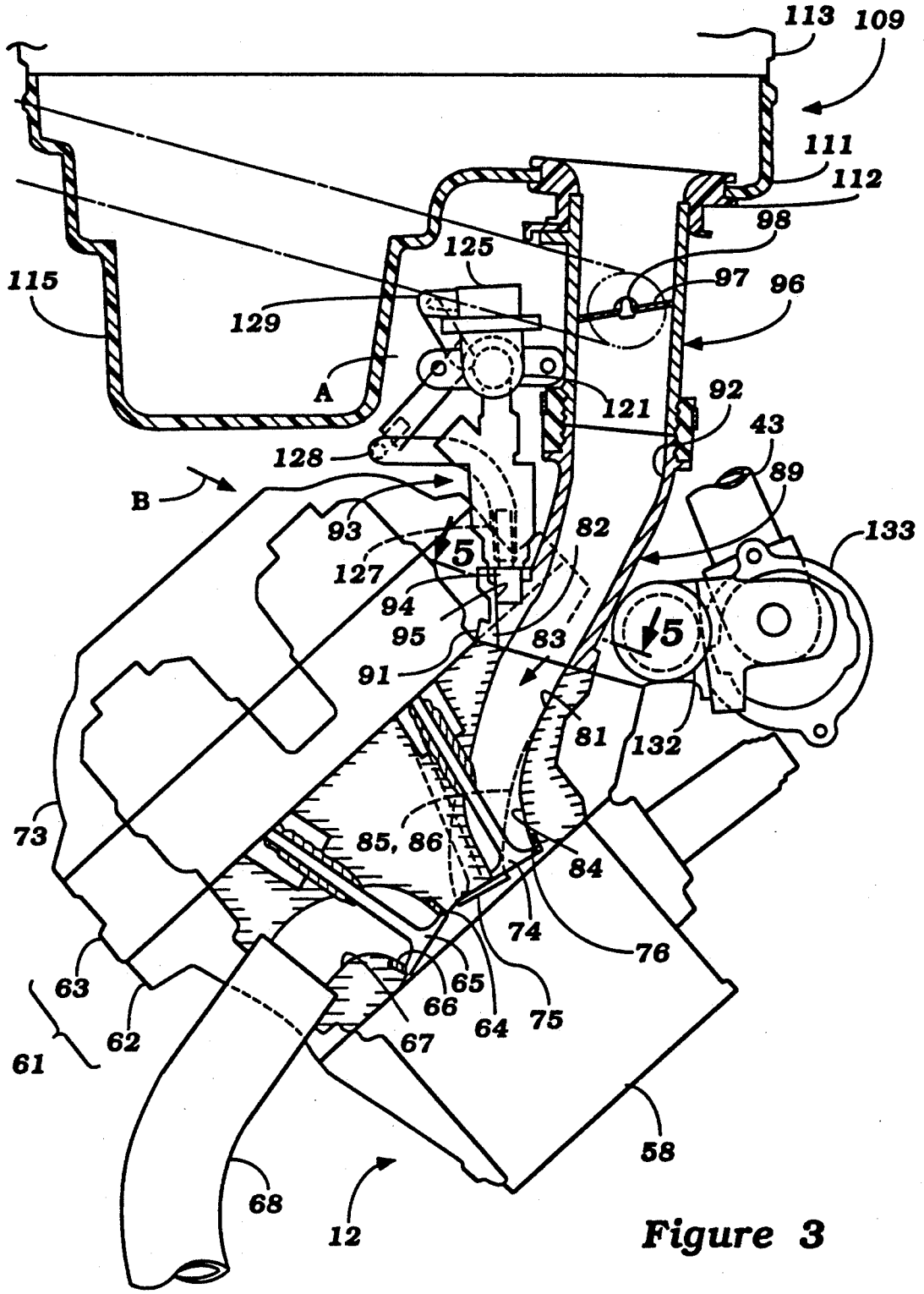
FIG. 3 is a further enlarged side elevational view of the upper portion of the engine with portions shown in cross section.

Referring now additionally to FIG. 3, the cylinder block 58 is shown in side elevation since the internal construction of the cylinder bores, pistons, connecting rods, etc. may be conventional and, for that reason, a description of them is not believed to be necessary. However, a cylinder head assembly, indicated generally by the reference numeral 61 and which is comprised of a lower cylinder head portion 62 and an upper cam carrier portion 63, is affixed to the cylinder block 58 in a suitable manner. The cylinder head 62 is shown in cross section so as to illustrate the induction system and the exhaust system and particularly the induction system associated with a single of these cylinders since the invention resides in the induction system.

It will be noted that the cylinder head 62 has a recess 64 which forms in part the combustion chamber with the cylinder bore and piston which, as has been noted, are not illustrated because they may be of any conventional type. The cylinder head assembly 61 is of the five valve type; that is, it includes three intake valves and two exhaust valves for each cylinder. The paired exhaust valves are not shown, but a single of these valves appears in FIG. 3 and is identified generally by the reference numeral 65. The valves 65 each cooperate with valve seats 66 formed at the base of a pair of exhaust passages 67 which extend from these valve seats to either a single or a Siamese type exhaust port in the side of the cylinder head 62. An exhaust manifold 68 has collector sections that cooperate with each of these exhaust ports and forms a portion of an exhaust system, indicated generally by the reference numeral 69. The exhaust manifold 68 extends forwardly and downwardly and then turns beneath the engine to deliver the exhaust gases to a muffler/catalyzer assembly 71 which is positioned beneath the transmission crankcase assembly 58. The exhaust gases are then discharged to the atmosphere through an exhaust system including one or more tail pipes 72.

The exhaust valves 65 are disposed in generally side by side relationship on one side of a plane containing the cylinder bore axis. The valves 65 are disposed at an acute angle to this plane and are operated by means of an overhead cam shaft that is contained within a cam cover 73 that is affixed to the cylinder head assembly 61 in any known manner.

Disposed on the other side of this plane are three intake valves comprised of a center intake valve 74 and a pair of side intake valves 75. The center intake valve 74 is disposed at a lesser acute angle to the aforenoted plane than the exhaust valves 65 while the side intake valves 75 are disposed at a greater angle to this plane than the exhaust valves 65 with the intake valves 75 being disposed at the same angle to this plane. The intake valves 74 and 75 are also operated directly by means of an intake cam shaft that is journaled in the cylinder head assembly in the cam carrier 63 and which is covered by the cam cover 73. The intake and exhaust cam shafts are driven from the engine output shaft in any known manner and rotate about axes that are parallel to the axis of rotation of the engine output shaft.

The invention deals primarily with the way in which a charge is delivered to the intake valves 74 and 75 for admission to the combustion chamber which, as aforenoted, is defined in part by the cylinder head recess 64. It should also be noted that the side intake valves 75 may have their head portions extending slightly over the aforenoted plane when the valves are all in their closed position. The induction system will now be described initially by particular reference to FIGS. 3–5.

It should be noted that the center intake valve 74 cooperates with a valve seat 76 that is pressed into the cylinder head 62 and which is disposed at the periphery of the cylinder bore. The side intake valves 75 cooperate with respective valve seats 77 and 78 that are pressed into the cylinder head and which are disposed closer to the cylinder bore axis which is indicated at A in the figures. It should be noted that a spark plug (not shown) is positioned within a bore 79 formed in the cylinder head 62 substantially on this axis.

In order to facilitate the formation of the intake passages, a Siamese type induction system is incorporated for each cylinder of the engine and this includes an inlet opening 81 formed in an upper rear side surface of the cylinder head 62. The openings 81 associated with each cylinder or combustion chamber of the engine are aligned with each other along the cylinder head surface, which is identified generally by the reference numeral 82. It should also be noted that the openings 81 are offset from the cylinder bore axis A with their centers indicated by the line b being offset by a distance D. All openings 81 associated with each cylinder are not offset in the same direction, but the openings may be staggered in their offset relative to each other to provide a more compact assembly. For example, the two end cylinders on each side of a transverse center line passing through the center of the cylinder block 58 may have their openings 81 extending toward this center plane so that the offset distance D is toward the center plane, while the two cylinders on the other side may be similarly offset toward the center plane. This will confine the induction system between the ends of the engine so as to provide a more compact assembly.

Each Siamese induction passage is identified generally by the reference numeral 83 and is comprised of a common portion which extends from the inlet opening 81 toward the valve seats 76, 77 and 78 which also may be termed the intake ports of the engine. However, the common portion of the intake passage 83 is then divided into a central part 84 and a pair of side parts 85 and 86, respectively, by walls 87 and 88 of the cylinder head 62. These passage portions 84, 85 and 86 extend to and terminate at the valve seats or valve ports 76, 77 and 78 respectively.

It should be noted that the center b of the inlet opening 81 is offset from the center of the center intake port 76 toward the side intake port 77 by the aforenoted distance D. As a result, there is some inclination to the intake passage 84 and although the passages 85 and 86 diverge from each other, they extend generally parallel to each other where they meet their respective valve seats 77 and 78. The final portion of the passage 84 is also generally parallel, but the parallel section is quite short. Also, it should be noted that the wall 87 is longer than the wall 88 so that the passage portion 86 is longer than the passage portion 85. This difference in wall length appears in Figure 4 and is identified by the dimension e. As a result of this greater length, there will be a higher velocity to the flow passing through the side intake port 78 than through the other intake ports and this will induce some slight swirl, as indicated by the arrow f.

It should be noted that the centers of the intake ports 77 and 78 are substantially on a line D that extends parallel to the cylinder head surface 82 and the axis of rotation of the cam shafts and engine crank shaft.

An intake manifold, indicated generally by the reference numeral 89, has a flange portion 91 that is affixed to the cylinder head 62 in mating relationship with the cylinder head surface 82. The intake manifold 89 has a plurality of individual runners 92 that form a continuation of the inlet portion of the individual intake passages 83 extending from their inlet openings 81 in a generally upward direction. As installed in the motorcycle 11, the manifold runners 91 extend in a generally vertical direction. In addition, the runners 91 continue along a flow path that is inclined inwardly toward the center of the engine and thus forms an extension of the inlet opening 81 from the point b and centered around this point.

Figure 4:
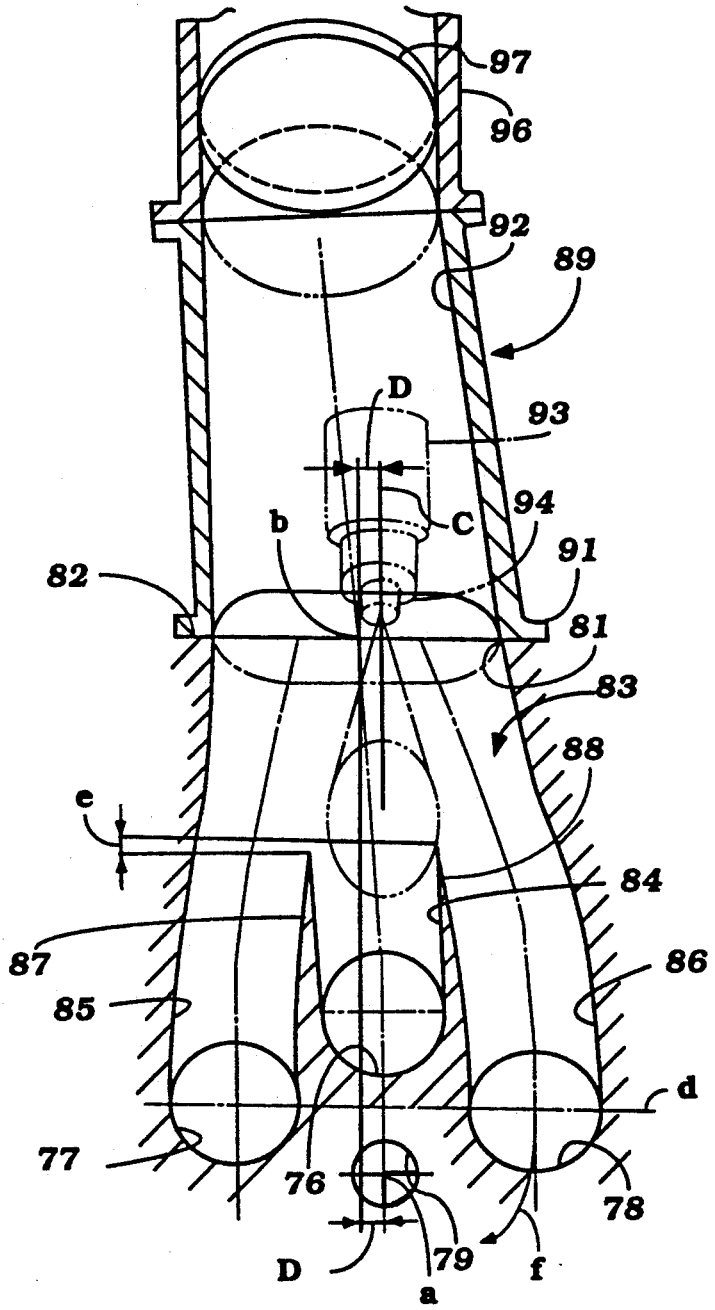
FIG. 4 is an enlarged cross sectional view taken through the induction system for one cylinder of the engine.
Figure 5:
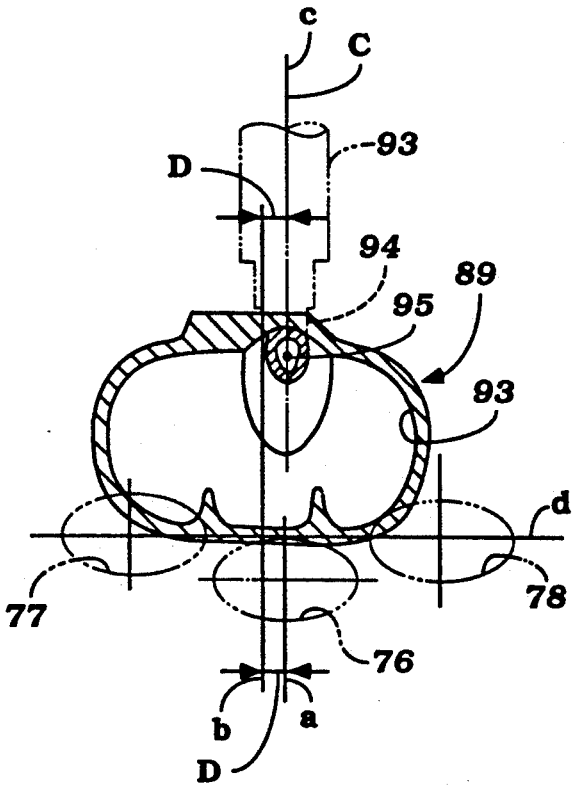
FIG. 5 is an enlarged cross sectional view taken along the line 5—5 of FIG. 3.

A plurality of individual fuel injectors 93, one for each cylinder, which may be of the electrically operated type actuated by an electrical solenoid valve are mounted with their discharge nozzles 94 extending into a recess 95 of the manifold 89 adjacent each runner 92 and configured relative to the runners and intake passages 83 as may be best seen in FIGS. 4 and 5. It should be noted that the fuel injectors 93 are disposed so that their nozzle portions 94 are offset from the point b toward the center of the center intake port 76 and toward the side intake port 78 away from the side intake port 77. The fuel injectors 93 are set so that their spray axis will extend perpendicularly to the line D and pass toward the center of the center intake passage portion 84. This offset distance D from the point b is the same as the offset distance D where the center b of the inlet opening 81 is offset but in the opposite direction. Of course, there may be some differences in the degree of offset depending upon the intake passage and port configuration. In any event, however, the disposition is such that the fuel injectors 93 will spray fuel equally to each of the intake passage portions 84, 85 and 86 so as to provide uniform mixture strength entering the combustion chamber recesses 64.

Figure 7:
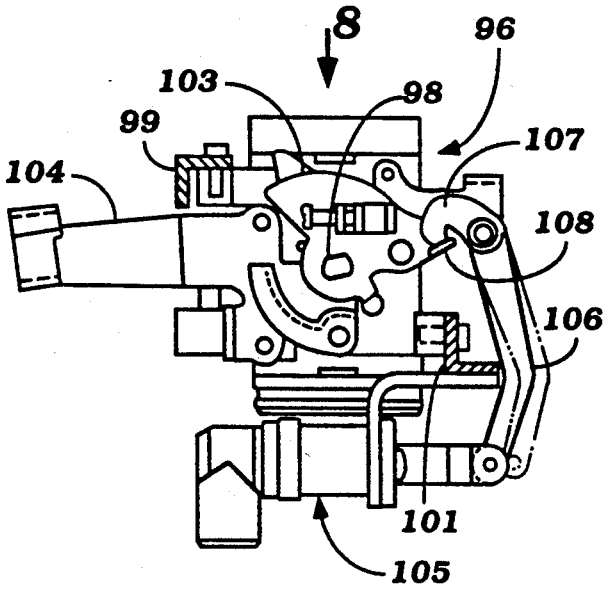
FIG. 7 is a side elevational view of one of the throttle bodies.
Figure 8:
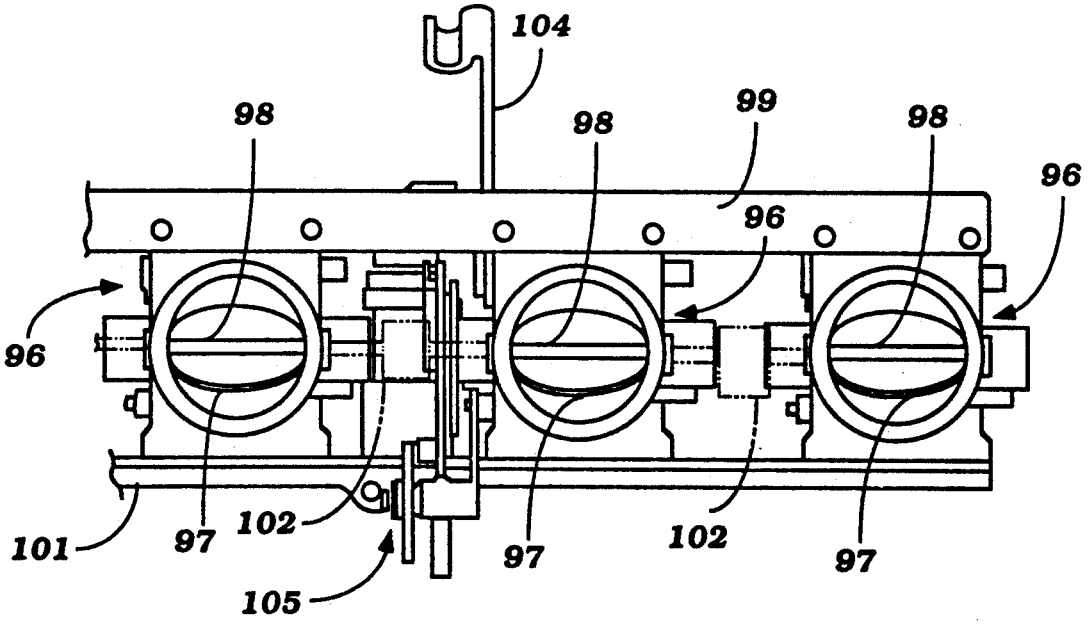
FIG. 8 is a view looking in the direction of the arrow 8 in FIG. 7.

A throttle body assembly, indicated generally by the reference numeral 96, is affixed to the upper end of the intake manifold 89 and journals a plurality of throttle valves 97 each affixed to a throttle valve shaft 98. It should be noted and as is best seen in FIGS. 7 and 8, the throttle bodies 96 are each individual elements that are connected together by means of upper and lower brackets 99 and 101. Alternatively, a single piece assembly may be employed if desired. In addition, connectors 102 interconnect the throttle valve shafts 98 of the respective throttle bodies, assuming that separate assemblies are employed. The connectors 102 ensure that the throttle valves 97 will all be operated in unison.

A throttle control lever 103 is affixed to the throttle valve shaft 98 and is operated by means of a wire actuator (not shown) which has its outer protective sheath fixed to a support bracket 104 in a well known manner.

To assist in cold starting and cold running, a throttle opening device, in the form of a temperature responsive wax pellet unit 105, is mounted on the bracket 101 and has an actuator that operates a link 106 having an end 107 that contacts a tang 108 on the throttle control lever 103 for rotating the throttle valves 97 to a partially opened position when the engine is cold. This will provide a greater air flow and quicker warmup. As the engine reaches operating temperature, the wax pellet 105 will contract causing the lever 106 to pivot back to its at rest position and return the throttle valves 97 to their normal idle position.

Referring now additionally to FIG. 2, an air inlet device, indicated generally by the reference numeral 109, is provided for supplying a filtered and silenced supply of air to the throttle bodies 96. The air inlet device 109 has a generally box-like configuration and is comprised of a lower member 111 that has gasketed openings 112 that are received on the upper ends of the throttle bodies 96 and supply air thereto. An upper member 113 encloses the air inlet device 109. The air inlet device 109 is divided into two box-like chambers across which respective filter elements 114 extend. Air is delivered from the atmosphere to these box portions, which are indicated generally by the reference numeral 115, by means of a pair of rearwardly facing inlet ducts 116 which lie beneath the glove box 42 (FIG. 1).

The filtered air then flows upwardly and can enter the throttle bodies 96 through elbow-like air trumpets 117 which are affixed to the throttle bodies within the air box 109.

It should be noted that the air boxes 115 and the throttle bodies 96 define a recessed area indicated by the letter A in FIG. 3. It is into this recessed area that the fuel injectors 93 extend and hence, the fuel injectors 93 will be in fact concealed and enclosed by the intake manifold 89, throttle bodies 96 and air inlet device 109. As a result of this confinement, any noise generated by the opening and closing of the injector valves and the actuation by the solenoids associated therewith will be well dampened and this noise will be silenced from the rider.

As may be seen in FIG. 1, the upper portion 113 of the air box 109 is provided with a recess 118 in its upper surface in which the control box 119, afore referred to, is positioned. The control box 119 controls the components of the engine such as the injection system and ignition system and is accessible, as aforenoted, by the access door 44 in the base of the glove box 42.

A fuel manifold or fuel rail 121 has suitable nipples to receive the fuel inlet portions of the fuel injectors 93. Because of the afore described configuration, the fuel injectors 93 may be disposed so that their longitudinal axes are parallel to each other and this permits the use of a straight line fuel rail and manifold 102. Fuel is delivered to the fuel rail 121 from the fuel tank 39 under the pressure from a fuel pump (not shown) which, in turn, delivers the fuel to a fuel filter 122 which, in turn, supplies an inlet end 123 of the fuel rail 121 through a conduit 124. A pressure regulator 125 is disposed at the opposite end of the fuel rail and is mounted to a bracket 126 formed at this end. The fuel pressure regulator 125 maintains the desired fuel pressure in the fuel rail 121 for supply to the injectors 93 by by-passing excess fuel back to the fuel tank 39 through a suitable conduit.

The intake manifold 89 is provided with a plurality of vacuum pressure sensor ports 1287 in their flange portions 91. Conduits 128 and 129 supply this pressure signal to both the fuel pressure regulator 125 via a conduit 129 and to a pressure sensor 131 via a conduit 132. The pressure sensor 131 supplies this pressure signal to the control box 119 for controlling the engine in the desired strategy.

Figure 6:
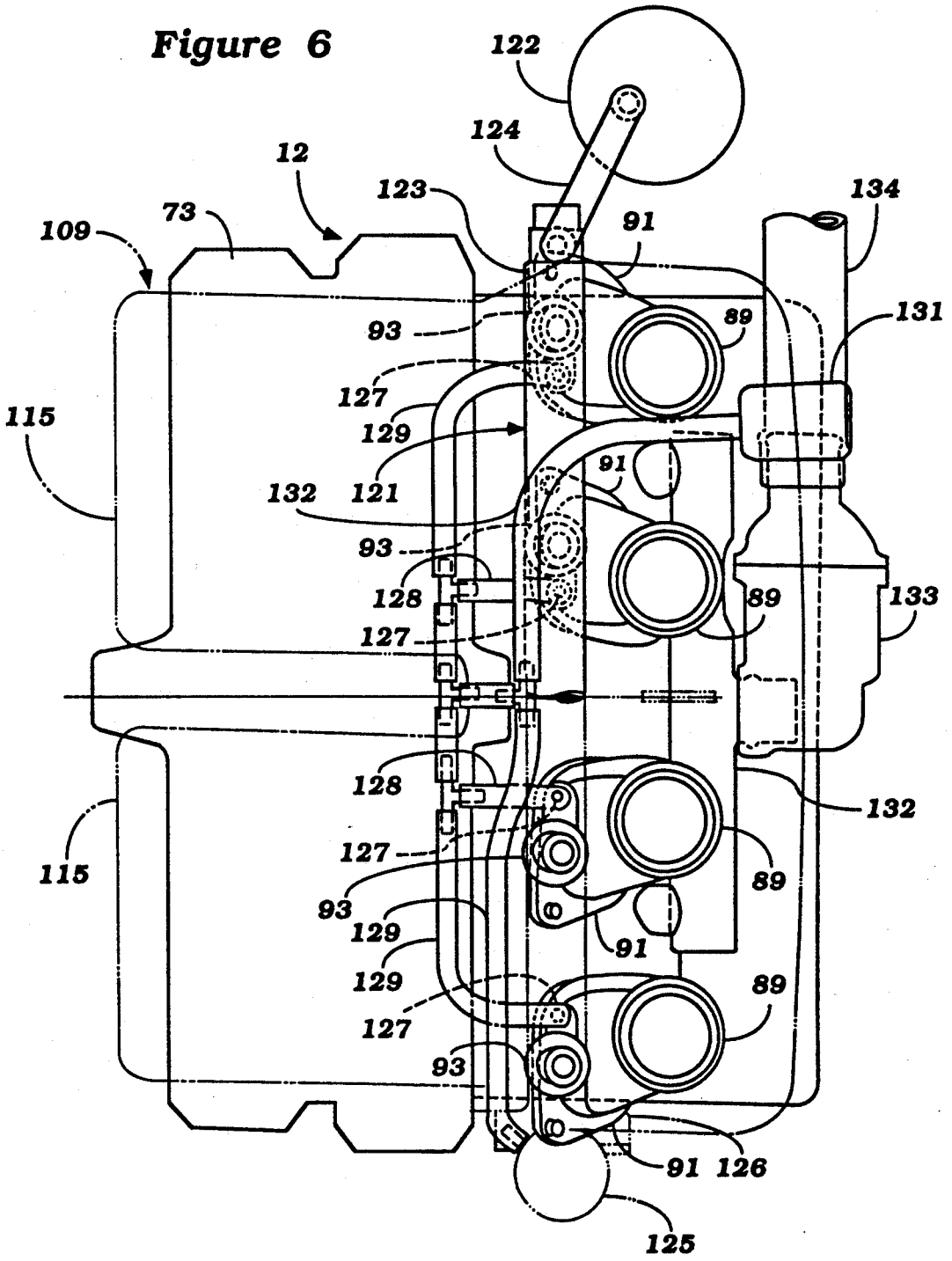
FIG. 6 is a top plan view of the engine looking in the same direction as FIG. 2 with the air induction system removed so as to more clearly show the relationship of components of the induction system.

A portion of the engine cooling system appears in FIGS. 3 and 6 and this includes a water manifold 132 that is affixed to the back side of the cylinder head 62 and which communicates with a thermostat assembly 133 for returning coolant to the radiator header tank 51 through a flexible conduit 134.

It should be readily apparent from the foregoing description that the described induction system permits a very compact assembly employing Siamese intake passages for a three intake valve engine and a single fuel injector so as to provide equal flow to all of the intake ports of the engine. In addition, the construction permits the fuel injectors to be all disposed so that they extend substantially parallel to each other to permit the use of a simple and single fuel rail for supplying all fuel injectors. Of course, the foregoing description is that of a preferred embodiment of the invention and various changes and modifications may be made without departing from the spirit and scope of the invention, as defined by the appended claims.

I claim:

1. An internal combustion engine having a combustion chamber, at least three intake ports serving said combustion chamber in side by side fashion comprising a center intake port and a pair of side intake ports, a common intake opening formed in an external surface of said engine, a Siamese type intake passage system extending from said intake opening to each of said intake ports for delivering a charge to said intake ports, said common intake opening being offset from the center of said center intake port toward one of said side intake ports, and a fuel injector for spraying fuel into said intake passages from a point offset from the center of said intake opening toward the center of said center intake port.

2. An internal combustion engine as set forth in claim 1 wherein the intake passage system comprises a single inlet portion branched into three individual outlet portions each communicating with a respective one of the intake ports.

3. An internal combustion engine as set forth in claim 2 wherein the outlet portions are divided from each other by internal walls and the wall separating the center intake passage portion from the one side intake passage portion terminates a greater distance from the center intake port than the wall separating the center intake passage portion from the other side intake passage portion.

4. An internal combustion engine as set forth in claim 3 wherein the fuel injector has a discharge spray axis that is disposed substantially perpendicularly to a line passing through the centers of the side intake ports.

5. An internal combustion engine as set forth in claim 4 further including an intake manifold fixed to the engine surface around the common intake opening and communicating therewith and wherein the fuel injector is disposed between the intake manifold and the portion of the engine in which the opening is formed.

6. An internal combustion engine as set forth in claim 1 wherein the combustion chamber is defined at least in part by a cylinder head and the intake ports, intake passage system and common intake opening are all formed in the cylinder head.

7. An internal combustion engine as set forth in claim 6 wherein the intake passage system comprises a single inlet portion branched into three individual outlet portions each communicating with a respective one of the intake ports.

8. An internal combustion engine as set forth in claim 7 wherein the outlet portions are divided from each other by internal walls and the wall separating the center intake passage portion from the one side intake passage portion terminates a greater distance from the center intake port than the wall separating the center intake passage portion from the other side intake passage portion.

9. An internal combustion engine as set forth in claim 8 wherein the fuel injector has a discharge spray axis that is disposed substantially perpendicularly to a line passing through the centers of the side intake ports.

10. An internal combustion engine as set forth in claim 9 further including an intake manifold fixed to the engine surface around the common intake opening and communicating therewith and wherein the fuel injector is disposed between the intake manifold and the portion of the engine in which the opening is formed.

11. An internal combustion engine as set forth in claim 10 wherein the engine has a plurality of combustion chambers defined by aligned cylinders and wherein all of the fuel injectors extend parallel to each other and are supplied with fuel from a common fuel rail.

12. An internal combustion engine having a cylinder bank with a plurality of aligned cylinders, each of said cylinders being served by at least three intake ports comprised of a center intake port and a pair of side intake ports, said engine having a plurality of intake openings formed along one side of said engine in aligned fashion, there being one intake opening for each of said cylinders, a plurality of Siamese intake passages each extending from one of said intake openings to the intake ports of the respective cylinder, the center of each of said intake openings being offset from the center of the center intake port served by the respective intake opening, a plurality of fuel injectors, one for each cylinder, each of said fuel injectors being disposed relative to its respective intake opening for spraying fuel in a direction along a single spray axis in said alignment with the center axis of the respective center intake port served by the respective intake opening, said fuel injectors all extending substantially parallel to each other, and a common fuel rail for delivering fuel to each of said fuel injectors.

13. An internal combustion engine as set forth in claim 12 wherein each intake passage system is comprised of a single inlet portion branched into three individual outlet portions each communicating with a respective one of the intake ports.

14. An internal combustion engine as set forth in claim 12 wherein the outlet portions of each of the intake passages are divided from each other by internal walls and the wall separating the center intake passage portion from one side intake passage portion terminates a greater distance from the center intake port than the wall separating the center intake passage portion from the other side intake passage portion.

15. An internal combustion engine as set forth in claim 12 wherein the fuel injector has a discharge spray axis that is disposed substantially perpendicularly to a line passing through the centers of the side intake ports.

16. An internal combustion engine as set forth in claim 15 further including an intake manifold fixed to the engine surface around the intake openings and communicating therewith and wherein the fuel injectors are disposed between the intake manifold and the portion of the engine in which the intake openings are formed.

17. An internal combustion engine as set forth in claim 12 wherein each combustion chamber is defined at least in part by a cylinder head and the intake ports, intake passage system and common intake openings are all formed in the cylinder head.

18. An internal combustion engine as set forth in claim 16 wherein each intake passage comprises a single inlet portion branched into three individual outlet portions each communicating with a respective one of the intake ports.

19. An internal combustion engine as set forth in claim 18 wherein the outlet portions of each of the intake passages are divided from each other by internal walls and the wall separating the center intake passage portion from the one side intake passage portion terminates a greater distance from the center intake port than the wall separating the center intake passage portion from the other side intake passage portion.

20. An internal combustion engine as set forth in claim 19 further including an intake manifold fixed to the engine surface around the inlet openings and communicating therewith and wherein the fuel injectors are disposed between the intake manifold and the cylinder head.

* * * * *

UNITED STATES PATENT AND TRADEMARK OFFICE

CERTIFICATE OF CORRECTION

PATENT NO. : 5,203,299

DATED : April 20, 1993

INVENTOR(S) : Hideaki Ueda

It is certified that error appears in the above-indentified patent and that said Letters Patent is hereby corrected as shown below:

Column 10, line 10, Claim 12, "said" should be --axial--.

Signed and Sealed this

Eighth Day of February, 1994

Bruce Lehman

*Attest:*

BRUCE LEHMAN

*Attesting Officer*

*Commissioner of Patents and Trademarks*